US007428906B2

(12) United States Patent
Asplund et al.

(10) Patent No.: US 7,428,906 B2
(45) Date of Patent: Sep. 30, 2008

(54) METHOD FOR CLEANING A STATIONARY GAS TURBINE UNIT DURING OPERATION

(75) Inventors: Peter Asplund, Hasselby (SE); Carl-Johan Hjerpe, Nacka (SE)

(73) Assignee: Gas Turbine Efficiency AB (SE)

( * ) Notice: Subject to any disclaimer, the term of this patent is extended or adjusted under 35 U.S.C. 154(b) by 419 days.

(21) Appl. No.: 10/538,672

(22) PCT Filed: Oct. 29, 2003

(86) PCT No.: PCT/SE03/01674

§ 371 (c)(1),
(2), (4) Date: Jun. 9, 2005

(87) PCT Pub. No.: WO2004/055334

PCT Pub. Date: Jul. 1, 2004

(65) Prior Publication Data

US 2006/0243308 A1 Nov. 2, 2006

(51) Int. Cl.
*B08B 3/02* (2006.01)
*B08B 9/00* (2006.01)

(52) U.S. Cl. ..... 134/22.1; 134/22.18; 134/23; 134/32; 134/33; 134/169 R; 134/198; 415/117

(58) Field of Classification Search ..... 134/22.1, 134/22.18, 23, 32, 33, 169 R, 198, 199; 415/116, 415/117; 60/39.53
See application file for complete search history.

(56) References Cited

U.S. PATENT DOCUMENTS 4,196,020 A 4/1980 Hornak et al. ..... 134/167 R
5,011,540 A 4/1991 McDermott ..... 134/23
5,193,976 A 3/1993 Kolev et al. ..... 415/116

(Continued)

FOREIGN PATENT DOCUMENTS

SE 0000262 7/2001

OTHER PUBLICATIONS

International Search Report PCT/SE2003/001674 dated Jan. 9, 2004.

*Primary Examiner*—Michael Barr
*Assistant Examiner*—Saeed T Chaundhry
(74) *Attorney, Agent, or Firm*—DLA Piper US LLP

(57) ABSTRACT

A method for cleaning a stationary gas turbine unit during operation, wherein the unit comprises a turbine, a compressor driven by the turbine, the compressor having an inlet, an air inlet duct arranged upstream of the air inlet of the compressor, the inlet duct having a part of the duct adjoining the inlet of the compressor and having decreasing cross section in the flow direction in order to give the air flow a final velocity at the inlet to the compressor. A spray of cleaning fluid is introduced in the inlet duct. The cleaning fluid is forced through a spray nozzle with a pressure drop exceeding 120 bar to form a spray the drops of which have a mean size that is less than 150 μm. The spray is directed substantially parallel to and in the same direction as the direction of the air flow. The spray is introduced at a position in the duct section where the air velocity is at least 40 percent of the final velocity at the compressor inlet, so that the drops of the liquid spray are caused to acquire a slip ratio of at least 0.8 at the compressor inlet.

32 Claims, 7 Drawing Sheets

U.S. PATENT DOCUMENTS 5,868,860 A * 2/1999 Asplund ..... 134/22.1
5,938,402 A 8/1999 Bochud et al. ..... 415/117
6,073,637 A * 6/2000 Hayward et al. ..... 134/22.1
6,553,768 B1 * 4/2003 Trewin et al. ..... 60/772
6,932,093 B2 * 8/2005 Ogden et al. ..... 134/22.1

* cited by examiner

METHOD FOR CLEANING A STATIONARY GAS TURBINE UNIT DURING OPERATION

CROSS REFERENCE TO RELATED APPLICATION

The present application is a 35 U.S.C. §§ 371 national phase conversion of PCT/SE2003/001674, filed 23 Oct. 2003, which claims priority of Swedish Application No. 0203697-8, filed 13 Dec. 2002. The PCT International Application was published in the English language.

The invention relates to a method for cleaning a stationary gas turbine unit during operation, with a spray of a cleaning liquid.

The invention thus relates to washing gas turbines equipped with axial or radial compressors. Gas turbines comprise a compressor for compressing air, a combustion chamber for burning fuel together with the compressed air, and a turbine to drive the compressor. The compressor comprises one or a plurality of compression steps, each compression step consisting of a rotor disc having blades and a following stator disc with guide vanes.

One object of the invention is to provide a method for cleaning blades and vanes from deposits of foreign substances by injecting fluid drops into the air flow upstream of the compressor. The fluid drops are transported with the air flow into the compressor where they collide with the surface of the rotor blades and guide vanes, whereupon the deposits are detached by the chemical and mechanical forces of the cleaning fluid. The invention is performed on gas turbines during operation. The gas turbine may be a part of a power plant, pump station, ship or vehicle.

BACKGROUND ART

Gas turbines consume large quantities of air. Air contains particles in the form of aerosols which are drawn into the compressor of the gas turbine with the air flow. A majority of these particles accompany the air flow and leave the gas turbine with the exhaust gases. However, some particles tend to adhere to components in the channels of the gas turbine. These particles form a deposit on the components, thus deteriorating the aerodynamic properties. As with increased roughness of the surface, the coating causes a change in the boundary layer flow along the surface. The coating, i.e. the increased roughness of the surface, results in pressure step-up losses and a reduction in the amount of air the compressor compresses. For the compressor as a whole this entails deteriorated efficiency, reduced mass flow and reduced final pressure. Modern gas turbines are equipped with filters to filter the air in front of the entrance to the compressor. These filters can catch only some of the particles. To maintain economic operation of the gas turbine, therefore, it has been found necessary to regularly clean the surface of the compressor components in order to maintain good aerodynamic properties.

Various methods for cleaning gas turbine compressors are already known. Injecting crushed nut shells into the air flow to the compressor has been found practically feasible. The drawback is that the nut-shell material may find its way into the internal air system of the gas turbine and result in clogging of ducts and valves.

Another cleaning method is based on wetting the compressor components with a washing fluid by spraying drops of the washing fluid into the air intake to the compressor. The washing fluid may consist of water or water mixed with chemicals. In the known cleaning method the gas turbine rotor is rotated with the aid of the start motor of the gas turbine. This method is known as "crank washing" or "off-line washing" and is characterised in that the gas turbine does not burn fuel during cleaning. The spray is produced by the cleaning fluid being pumped through nozzles which atomize the fluid. The nozzles are installed on the walls of the air duct upstream of the compressor inlet, or are installed on a frame placed temporarily in the intake duct.

The method results in the compressor components being drenched in cleaning fluid and the dirt particles being detached by the chemical effects of the chemicals, as well as mechanical forces deriving from rotation of the rotor. The method is considered both efficient and useful. The rotor speed during crank washing is a fraction of that at normal operation of the gas turbine. An important feature with crank washing is that the rotor rotates at low speed so that there is little risk of mechanical damage.

A method known from U.S. Pat. No. 5,011,540 is based on the compressor components being wetted with cleaning fluid while the gas turbine is in operation, i.e. while fuel is being burned in the combustion chamber of the gas turbine unit. The method is known as "on-line washing" and, in common, with crank washing, a washing fluid is injected upstream of the compressor. This method is not as efficient as crank washing. The lower efficiency is a result of poorer cleaning mechanisms prevailing at higher rotor speeds and high air speeds when the gas turbine is in operation. A specific quantity of washing fluid should be injected since too much washing fluid may cause mechanical damage in the compressor and too little washing fluid results in poor soaking of the compressor components. Another problem with the on-line washing method is that the washing fluid must not only be caught by the blade surface and guide vanes of the first step, it must also be distributed to the compressor step downstream of the first step. If a large proportion of the washing fluid is caught by the blade surface of the first step, the washing fluid will be moved to the periphery of the rotor due to centrifugal forces and will therefore no longer participate in the cleaning process.

The object of the invention is to fully or partially eliminate said problems.

BRIEF DESCRIPTION OF THE INVENTION

This object is achieved with the invention. The invention comprises a method for cleaning a stationary gas turbine unit during operation, wherein the unit comprises a turbine, a compressor driven by the turbine, the compressor having an inlet, an air inlet duct arranged upstream of the air inlet of the compressor, the inlet duct having a part of the duct adjoining the inlet of the compressor and having decreasing cross section in the flow direction in order to give the air flow a final velocity at the inlet to the compressor. A spray of cleaning fluid is introduced in the inlet duct. The cleaning fluid is forced through a spray nozzle with a pressure drop exceeding 120 bar to form a spray the drops of which have a mean size that is less than 150 μm. The spray is directed substantially parallel to and in the same direction as the direction of the air flow. The spray is introduced at a position in the duct section where the air velocity is at least 40 percent of the final velocity at the compressor inlet, so that the drops of the liquid spray are caused to acquire a slip ratio of at least 0.8 at the compressor inlet.

The invention will be described in the following by way of example with reference to the accompanying drawings.

DETAILED DESCRIPTION OF THE INVENTION

Figure 1:
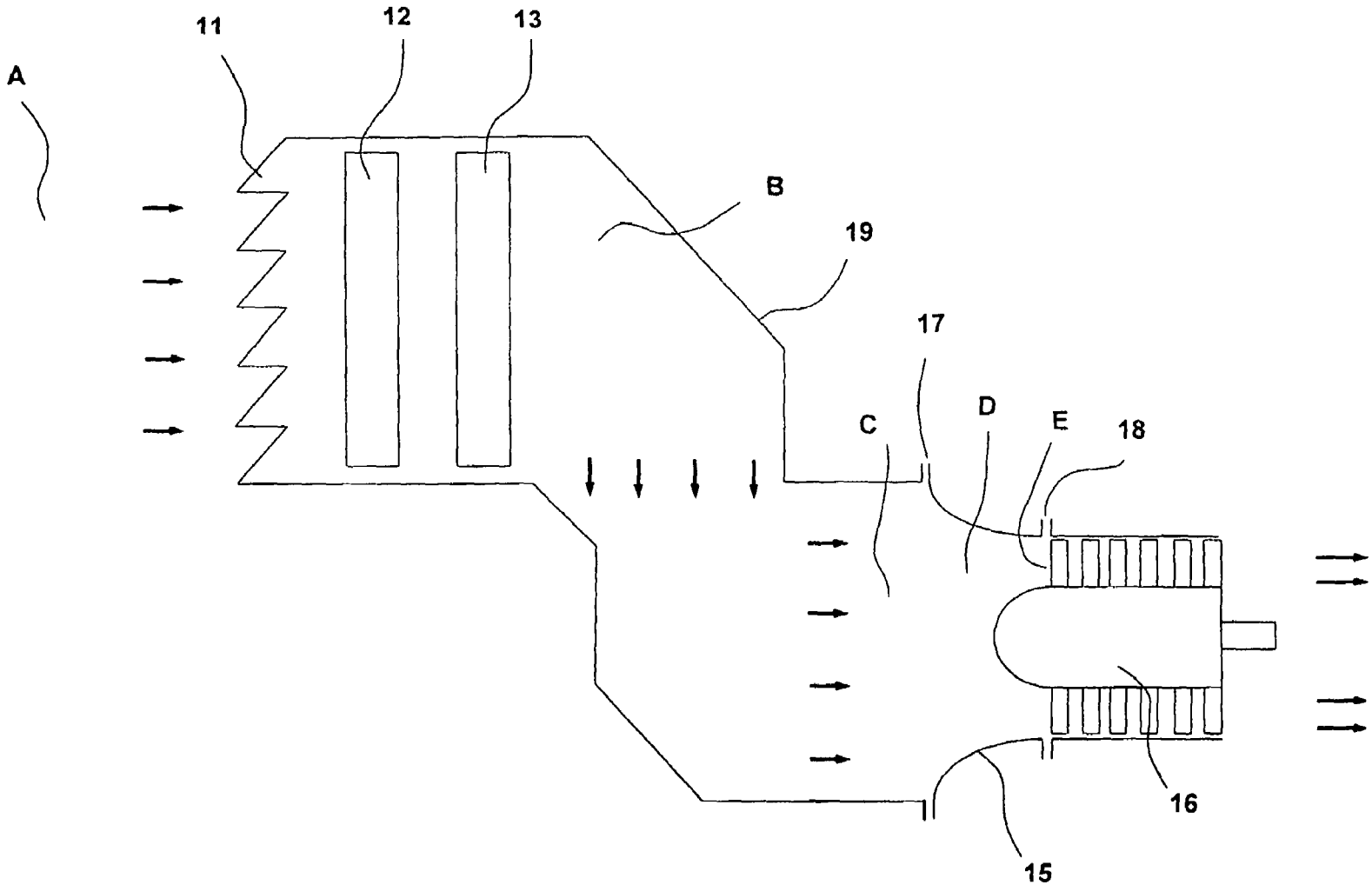
FIG. 1 shows the compressor and the air duct upstream of the compressor inlet.

Air drawn into the compressor is accelerated to high speeds in the air duct prior to compression. FIG. 1 shows the design of an air duct for a gas turbine. The direction of flow is indicated by arrows. The surrounding air A is assumed to have no initial velocity. After having passed weather protection 11, filter 12 and dirt trap 13 the air velocity at B is 10 m/s. The air velocity increases further at C to 40 m/s as a result of the decreasing cross sectional area of the air duct. Immediately prior to the first blade E of the compressor the air passes a duct especially designed to accelerate the air to extremely high speeds. Between its inlet C and its outlet E the acceleration duct 15 is called the "bell mouth" 15. The purpose of the bell mouth is to accelerate the air to the speed required for the compressor to perform its compression work. The bell mouth 15 is connected to the duct 19 by the joint 17. The bell mouth 15 is connected to the compressor 16 by the joint 18.

The velocity at E varies for different gas turbine designs. For large stationary gas turbines the speed at E is typically 100 m/s, while for small flight derivative turbines the speed at E may be 200 m/s. D is a point lying approximately mid-way between the inlet C and the outlet E. Within the scope of this invention A, B and C are low-speed areas while D and E are high-speed areas. Nozzles for washing fluid may be installed either in the low-speed area C or the high-speed area D.

One aim of installing nozzles in area C is that nozzles operating under a low pressure drop—so-called "low pressure nozzles" can be used. The spray will penetrate to the core of the air flow and transport the drops to the compressor intake. However, there is a drawback with installation in area C. The air and drops are accelerated in the bell mouth. The forces acting on the drops will result in different final speeds for the drops and the air when acceleration is complete at E. A "slip speed" occurs at E where slip speed is defined as the difference between the drop speed and the air speed. A "slip ratio" is defined as the ratio between the drop speed and the air speed, the drop speed constituting numerator and the air speed constituting denominator. This is explained in more detail in the following.

Alternatively the nozzles may be installed in the high-velocity area D. In the high-velocity area nozzles are preferred which operate under high pressure drop, so-called "high-pressure nozzles". The nozzle is directed substantially parallel to the air flow. The spray produced by the nozzle has high velocity and the abrasive speed between fluid and air flow that occurs during acceleration in the bell mouth can be substantially eliminated since drops and air flow have substantially the same speed. If, instead, the nozzles in area D were to operate under low pressure the spray would not achieve sufficient impetus to penetrate into the core of the air jet. Part of the fluid is caught by the boundary layer flow along the wall of the duct where it forms a film of liquid that is transported to the compressor by the thrust of the air flow.

The present invention relates to installing high-pressure nozzles in area D. The term "high pressure nozzles" means nozzles operating with a pressure drop of more than 120 bar, preferably 140 bar and maximally 210 bar. The upper limit is set by the risk of the drops acquiring such impetus that they might damage material surfaces in the turbine unit. In practice, an upper limit is 210 bar.

One object of the invention is to increase the impetus of the spray by the nozzle operating under high pressure. Liquid sprayed into an air duct is subjected to a compressive force by the air flow in the duct. The force on the spray is the result of the projected surface of the spray against the air flow, the force of inertia of the drops and the dynamic force of the air flow on the spray. The projected surface of the spray is in turn the result of the outlet velocity of the fluid, drop size and density of the spray. One skilled in the art can calculate that a given flow of liquid through the nozzle will increase the impulse of the spray produced if the outlet velocity of the fluid increases. In accordance with the invention, the increased outlet velocity is achieved by means of a high pressure.

Another object of the invention is to avoid a liquid film on the surface of the air duct by using a spray with a high impulse. It has been observed in actual gas turbine installations that a spray injected in an area of the air duct where high velocity prevails will not fully penetrate into the core of the air flow. Some of the liquid is caught by the boundary layer flow and forms a liquid film that is transported into the compressor, impelled by the thrust of the air flow. This liquid will contribute to cleaning the compressor blades and guide vanes and may cause mechanical damage. Formation of the liquid film can be avoided by injecting liquid through the nozzle under high pressure.

A third object of the invention is to reduce the abrasive speed. Air drawn into the bell mouth is subjected to acceleration. If the air contains fluid drops originating from a spray, for instance, the drops will also be accelerated. The velocity achieved by the drops in relation to the air speed is a result of cross-acting forces. First of all, an aerodynamic flow resistance results in a retarding force that acts on the drops. Secondly, a force of inertia acts on the drops as a result of the acceleration. The retarding force is directed oppositely to the force of inertia. When the acceleration ceases at the end of the bell mouth the drops have assumed a velocity lower than the air speed. An slip speed has thus arisen between the drops and the air flow.

The compressor is designed to compress the incoming air. In the rotor energy is converted to kinetic energy by the rotor blade. In the following stator guide vane the kinetic energy is converted to an increase in pressure through a decrease in speed.

The compressor is designed for operation about a design point. The aerodynamics around the blades and the guide vanes are most favourable at the design point. When the compressor operates under various load conditions and different air states, the actual operating point of the compressor will deviate from the design operating point. Less favourable aerodynamic conditions occur in the compressor when the actual operating point deviates from the design point. Normally this only causes a deteriorated degree of efficiency in the compressor, a certain deterioration in air capacity, and a somewhat lower pressure ratio. In the worst case the actual operating point may deviate so much from the design operating point that the compressor ceases to operate. In short, this means that in order to achieve satisfactory compression the air velocity in the compressor inlet must be adjusted to the design and operating conditions.

Yet another object of the invention is for the washing fluid to penetrate into the compressor past the first step. Referring to the above description concerning the air flow containing liquid drops it is obvious that, if the compressor operates under advantageous aerodynamic conditions and a slip speed exists between drop and air, the speed of the drop must be less advantageous as regards aerodynamics. By means of analysis it has been determined that if a slip ratio prevails between drops and air, the drops will encounter the blades and guide vanes unfavourably. Liquid will to a great extent wet the blades and vanes of the first step, whereas it would be desirable for the liquid to penetrate into the compressor past the first step. To achieve the above object of the invention, in an exemplary embodiment the cleaning fluid is sprayed such that a substantial portion of the drop of the spray has a mean size within the interval 50-150 μm. Further, in another exemplary embodiment a spray is utilized where the mean size of the drops remains substantially constant throughout the cleaning process. Thus, no large changes in the mean size of the drops occur during cleaning.

Preferred Embodiment of the Invention

As described above, the present invention offers new methods for the user that have never previously been available to him.

Figure 2:
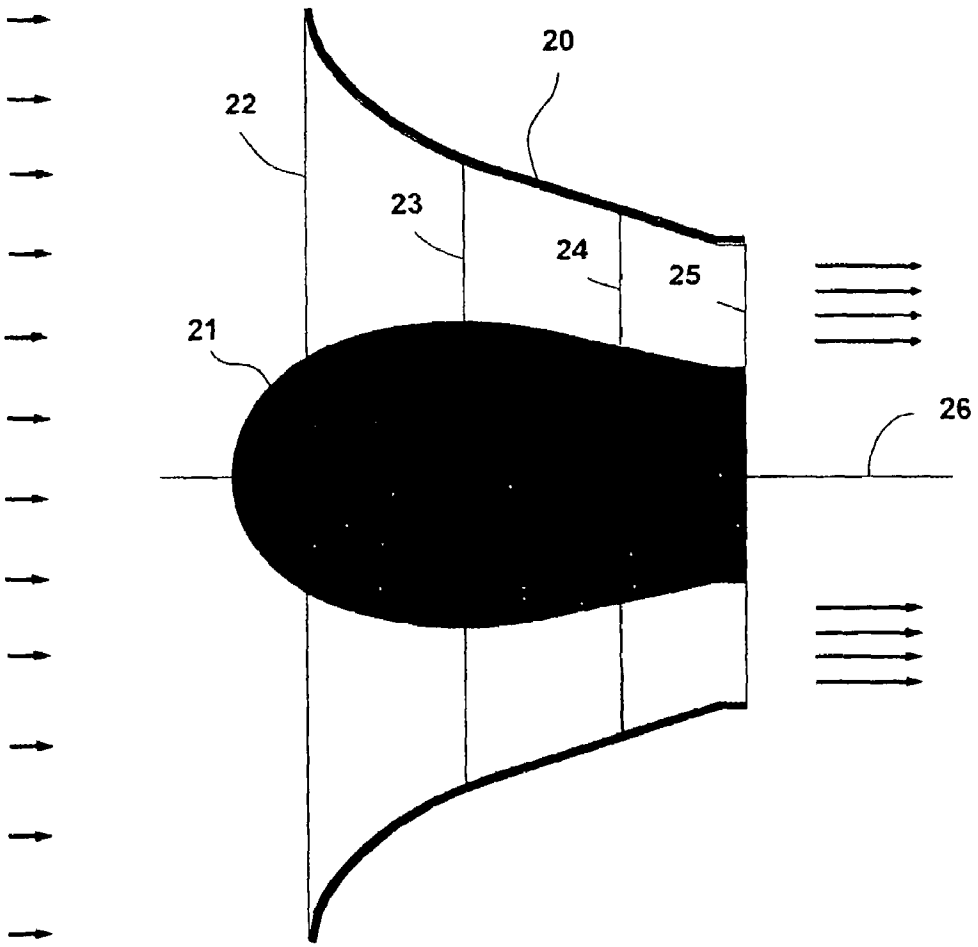
FIG. 2 shows a section through the air duct before the compressor inlet.

FIG. 2 shows the part of the inlet duct where the air accelerates to extremely high speeds, known as the bell mouth. This part of the duct is tubular and converges towards its outlet, i.e. towards the inlet into the compressor. The flow direction is indicated by arrows. The purpose of the bell mouth is to accelerate the air to the speed necessary for the compressor to perform the compression work. The bell mouth is symmetrical about the axis 26. The outer casing 20 and the inner casing 21 form the geometry of the bell mouth. Air enters the bell mouth at the cross section 22 and leaves at the cross section 25. The cross section 25 is equivalent to the first guide vane or rotor blade of the compressor. The velocity at the cross section 22 is 40 m/s. As a result of the geometry of the bell mouth the air accelerates to 100 m/s at the cross section 23, 170 m/s at the cross section 24, and 200 m/s at the cross section 25.

Figure 3A:
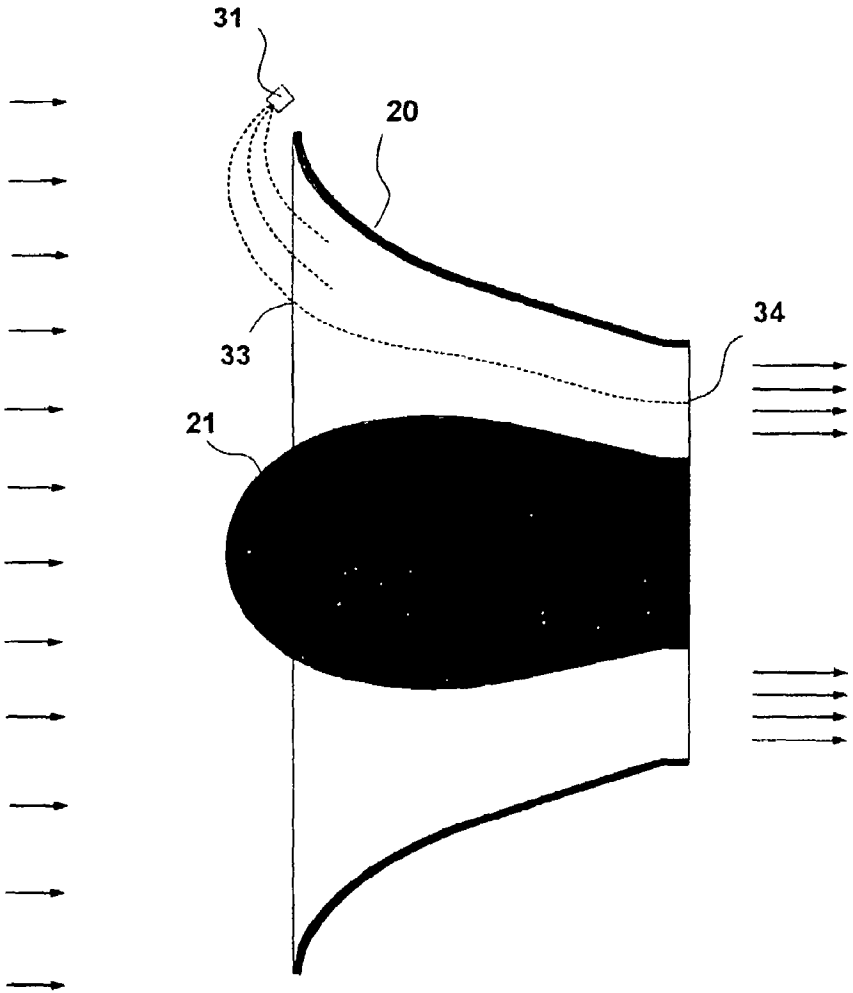
FIG. 3A shows a section through the air duct before the compressor inlet, indicating a feasible placing of the nozzle for injecting washing fluid.
Figure 3B:
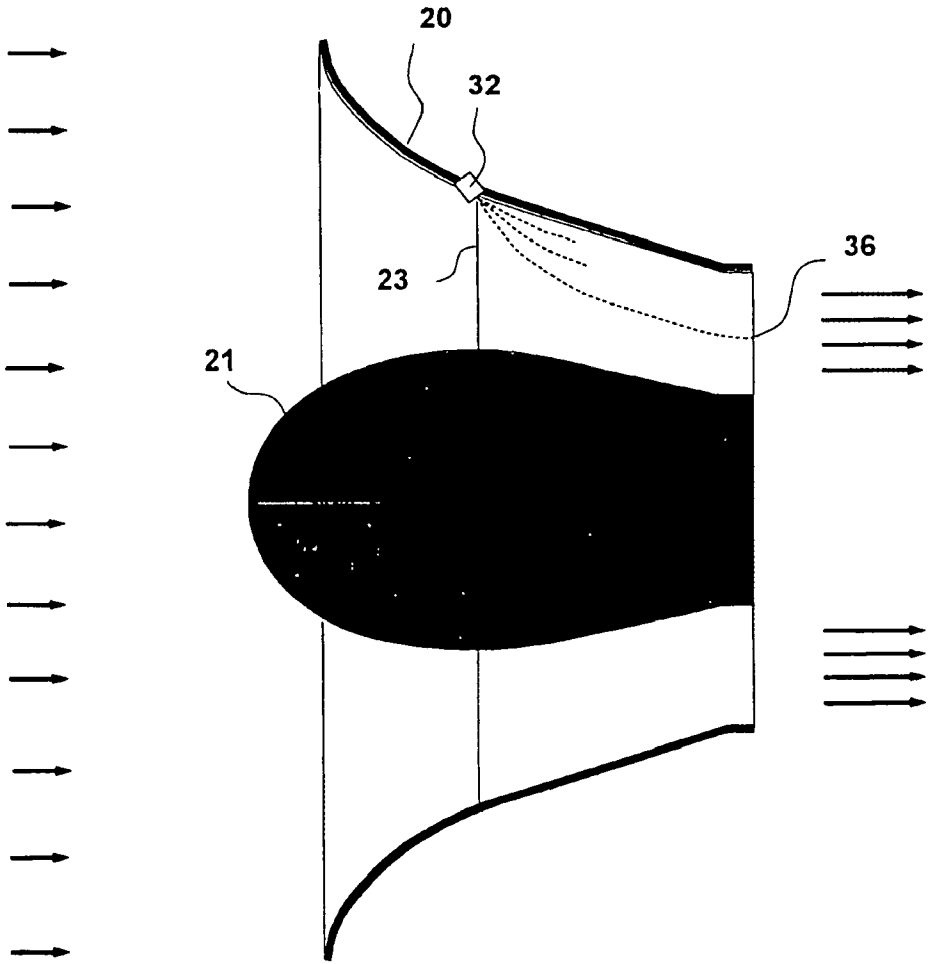
FIG. 3B shows a section through an air duct before the compressor inlet, indicating an alternative placing of the nozzle for injecting washing fluid, and exemplifies a preferred embodiment of the invention.

FIGS. 3A and 3B show alternative installations of the nozzles on one and the same bell mouth. Identical parts are given the same designations as in FIG. 2.

Nozzle 31 in FIG. 3A is installed upstream of the inlet to the bell mouth. The air speed is low here and low-pressure nozzles are to be preferred. When the liquid pressure is low the spray speed will be low. The drop velocity at cross section 33 may be assumed to be substantially equivalent to the air speed. When the drops are carried towards the compressor with the air flow, they are subjected to an increase in speed. The air speed at cross section 33 is 40 m/s and at the outlet 34 it is 200 m/s. Calculation of the equations for the slip speeds gives that the drop that had a speed of 40 m/s at the inlet 33 will have assumed a speed of 130 m/s at the outlet 34. The slip ratio is thus 0.65.

The nozzle in FIG. 3B is installed at cross section 23 which is in the high-speed area. A high-pressure nozzle is preferable. The nozzle is directed substantially parallel to the air flow. A nozzle operating at the pressure relevant in this invention has an outlet speed of 120 m/s. Calculation of the particle trajectory for the drop in accordance with the equations for the abrasive mechanism gives a speed of 190 m/s at the outlet 34. The slip ratio is thus 0.95.

Figure 4:
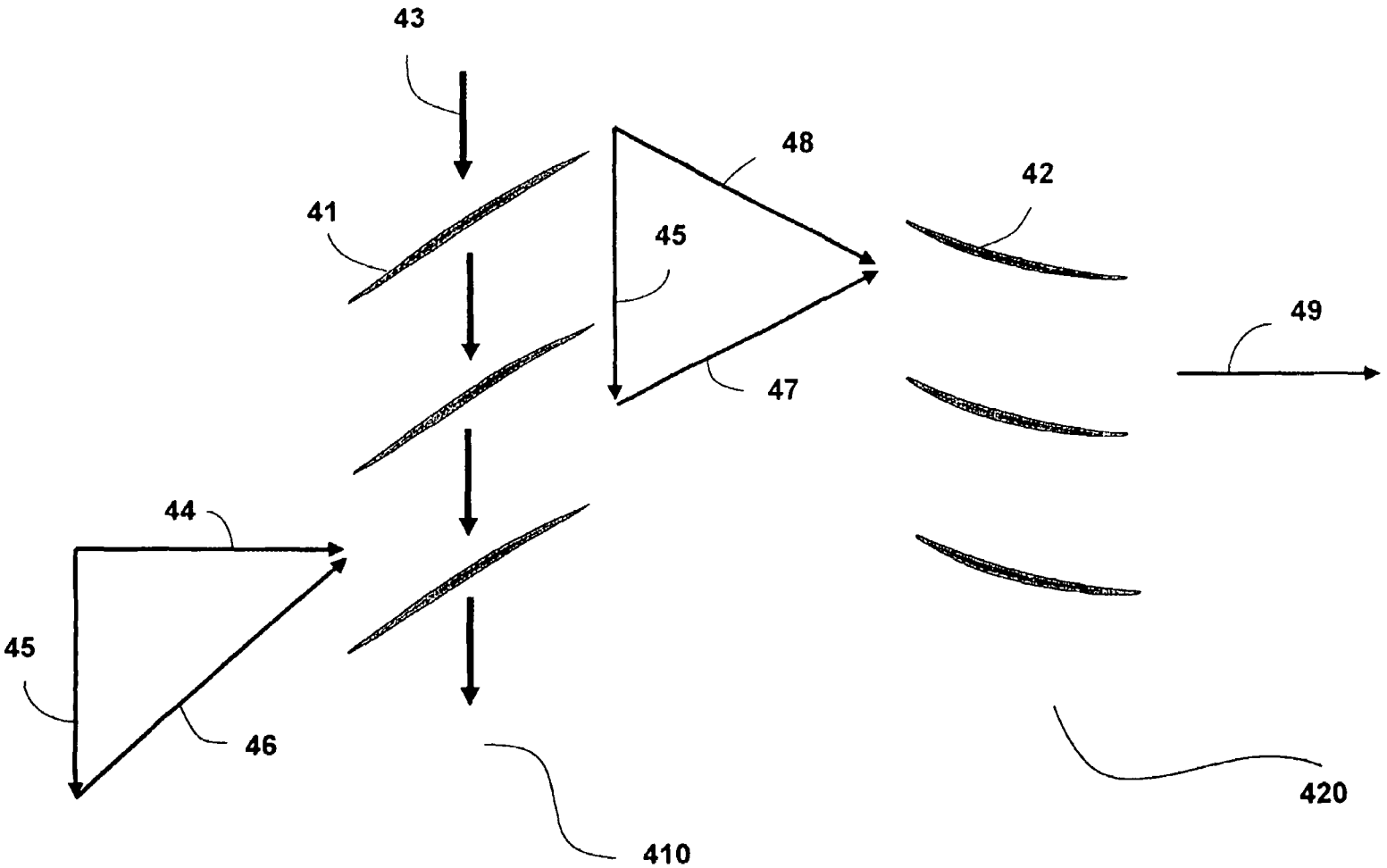
FIG. 4 shows flow patterns in a compressor step by illustration of "velocity triangles".

FIG. 4 shows the aerodynamics around rotor blades and stator guide vanes in an axial compressor. The blades and guide vanes are shown from the periphery of the rotor towards its centre. Rotor blade 41 is one of many blades constituting a rotor disc 410. The rotor rotates in the direction indicated by the arrow 43. The stator guide vane 42 is one of many guide vanes constituting a stator disc 420. The stator guides are fixed in the compressor casing. A rotor disc and following stator disc constitute a compression step. Air speeds are illustrated as vectors where the length of the vector is proportional to the speed, and the direction of the vector is the direction of the air flow. FIG. 4 shows the air flow through a compressor step. Air approaches the rotor disc with an axial speed ratio 44. The rotor disc rotates with the tangential speed vector 45. Relative vector 46 shows the movement of the air flowing into the space between the rotor blades. Vector 47 shows the movement of the air leaving the rotor disc. Vector 45 is the tangential speed of the rotor. Relative vector 48 shows the movement of the air flowing into the space between the guide vanes. Vector 49 shows the movement of the air leaving the stator disc.

Figure 5:
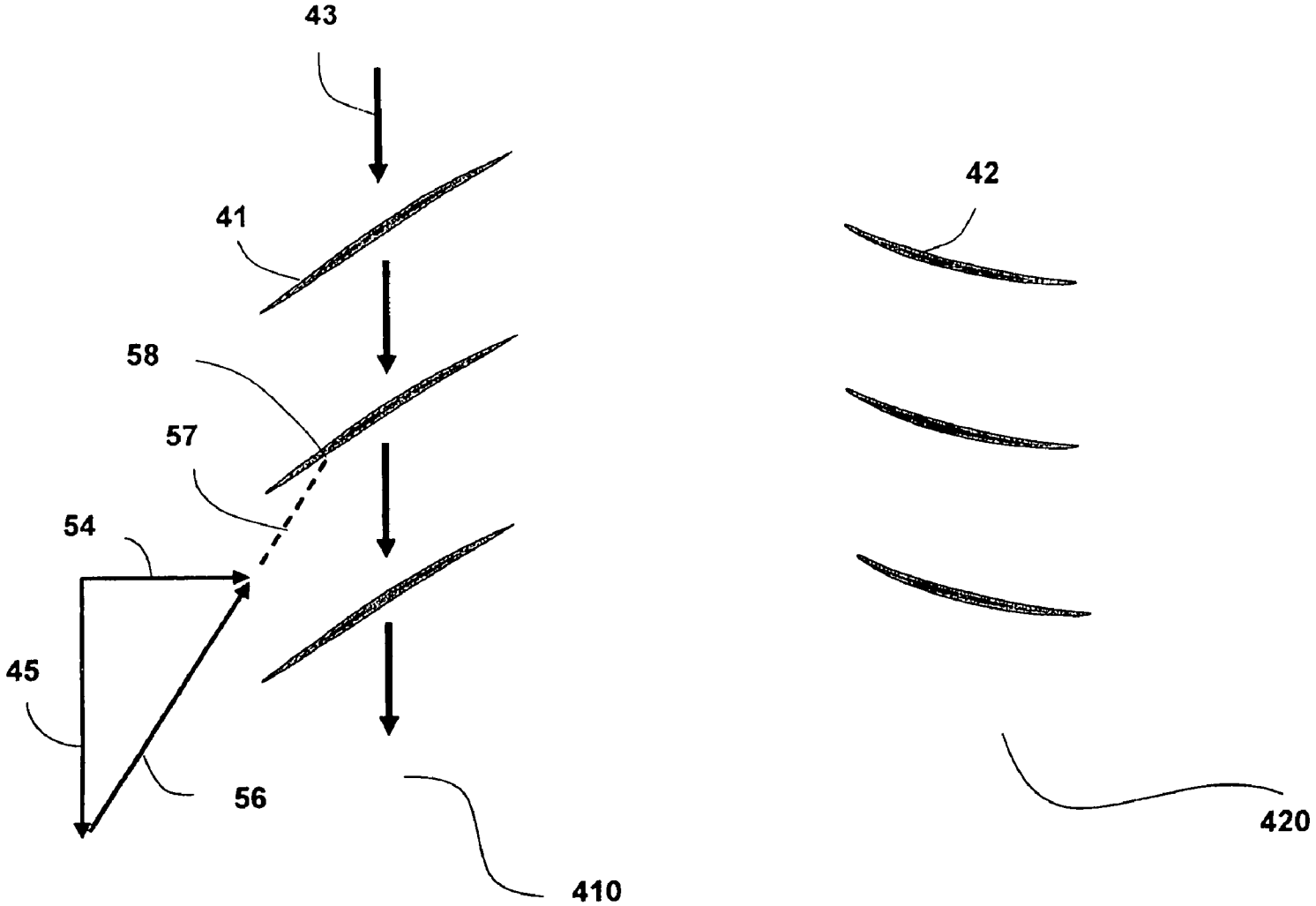
FIG. 5 shows velocity triangles for a drop of washing fluid from a nozzle under low pressure.

FIG. 5 illustrates the case with low-pressure nozzles installed in the low-speed area of the air intake. Identical parts have been given the same designations as in FIG. 4. Vector 54 shows the movement of a drop approaching the rotor disc with a slip ratio of 0.65. Vector 45 is the tangential speed of the rotor. Relative vector 56 shows the movement of a drop moving towards the space between the rotor blades. By extending the vector 56 as indicated by the broken line 57 it can be seen that the drop collides with the blade at point 58.

Figure 6:
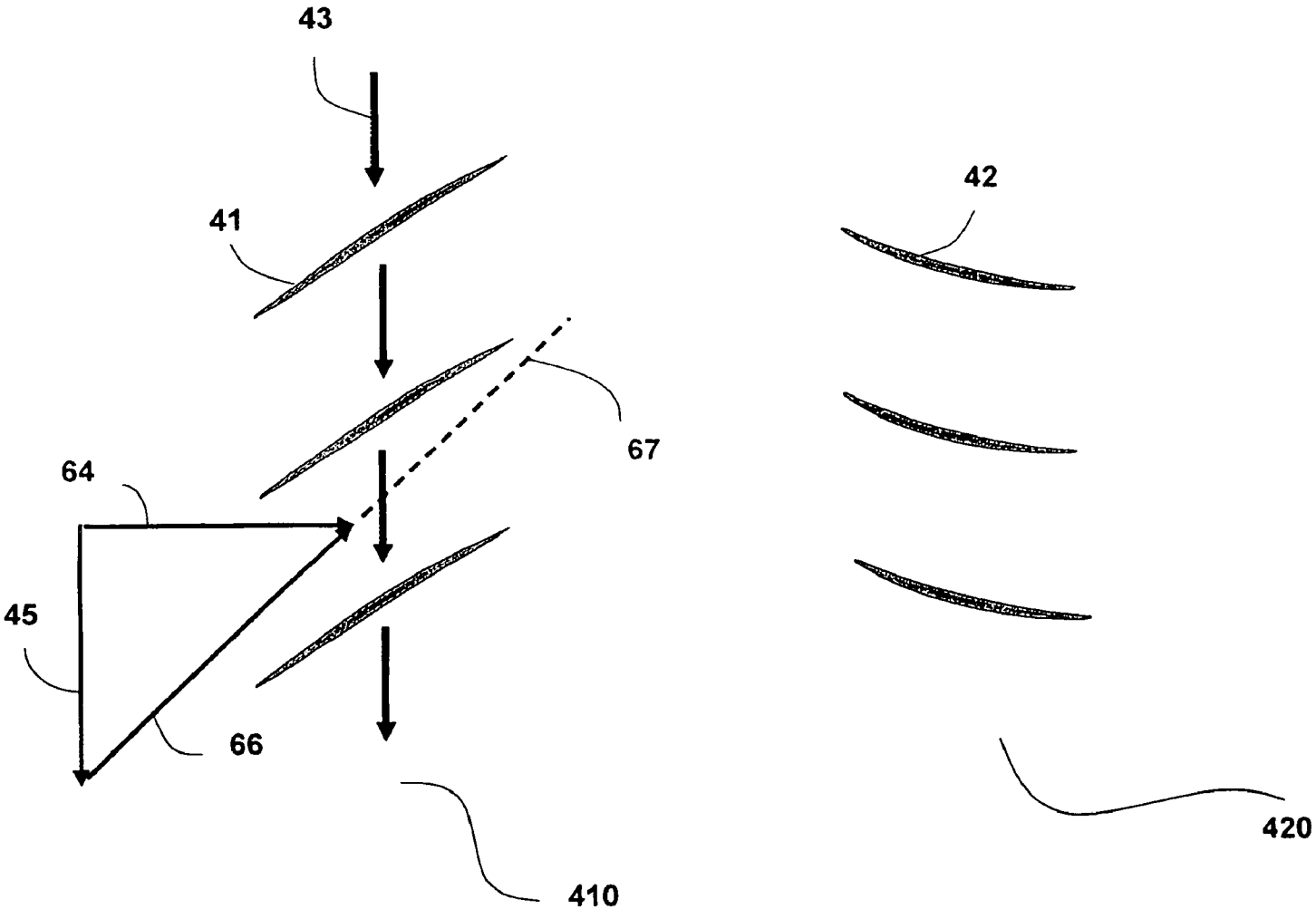
FIG. 6 shows velocity triangles for a drop of washing fluid from a nozzle under high pressure and exemplifies a preferred embodiment of the invention.

FIG. 6 illustrates the case with the high-pressure nozzle installed in the high-speed area of the air intake. Identical parts have been given the same designations as in FIG. 4. Vector 64 shows the movement of a drop approaching the rotor disc with a slip ratio of 0.95. Vector 45 is the tangential speed of the rotor. Relative vector 66 shows the movement of a drop moving towards the space between the rotor blades. By extending the vector 66 as indicated by the broken line 67 it is evident that the drop will not collide with the blade. This drop will continue past the rotor disc where corresponding analysis will determine whether the drop will collide with a guide vane in the stator.

An analysis of drop trajectories under various operating conditions in the gas turbine shows that if the nozzle operates with pressure in accordance with the invention, this will result in washing fluid being distributed to compressor steps downstream of the first step if the nozzle is installed in the area of the bell mouth where the speed is at least 40 percent of the final speed at the compressor intake, preferably at least 50 percent, and most preferably at least 60 percent of the final speed at the compressor intake. Naturally a somewhat better result is achieved the closer to the compressor intake the nozzle(s) is/are situated, but for practical reasons the nozzle cannot be placed immediately beside the compressor intake.

Although the present invention has been illustrated and described in relation to detailed embodiments thereof, one skilled in the art will realize that various modifications in shape and detail are possible without departing from the concept and scope of the invention defined in the claims.

The invention claimed is:

1. A method for cleaning a stationary gas turbine unit during operation, wherein the unit comprises: a turbine; a compressor driven by the turbine, the compressor having an air inlet; and an air inlet duct arranged upstream of the air inlet of the compressor, the inlet duct having an acceleration duct adjoining the inlet of the compressor and having decreasing cross section in an air flow direction in order to increase the velocity of the air moving through the acceleration duct, with the air flow having a final velocity at the inlet to the compressor; the method comprising:

providing at least one spray nozzle positioned at the acceleration duct; and introducing a spray of cleaning fluid within the acceleration duct wherein the cleaning fluid is forced through the at least one spray nozzle under sufficient pressure so as to form a spray of drops that penetrate the air flow, and with the spray being directed substantially parallel to and in the same direction as the direction of the air flow.

2. A method of claim 1, wherein the drops of the spray have a mean size that is less than around 150 μm.

3. A method of claim 1, wherein the air velocity is at least 40 percent of the final velocity at the compressor inlet.

4. A method of claim 1, wherein the drops of the fluid spray acquire a slip ratio of at least 0.8 at the compressor inlet.

5. A method of claim 1, wherein the cleaning fluid is forced through the spray nozzle with a pressure drop that is dependent on the location of the nozzle, and with the pressure drop within the acceleration duct being greater than a pressure drop occurring in the inlet upstream of the acceleration duct.

6. A method of claim 1, wherein cleaning fluid is forced through the spray nozzle with a pressure drop that is dependent on the location of the nozzle, and with the pressure drop within the acceleration duct being greater than a pressure drop occurring in the inlet upstream of the acceleration duct so that the drops of the spray stay in the air flow, to avoid leaving a liquid film within the inlet duct.

7. A method as claimed in claim 1, wherein the fluid spray is established so that a substantial proportion of its drops have a mean size within the interval of around 50-150 μm.

8. A method as claimed in claim 7, wherein the fluid spray drops are given a mean size of around 70 μm.

9. A method as claimed in claim 1, wherein the fluid spray drops are caused to acquire a slip ratio of at least 0.9 at the compressor inlet.

10. A method of claim 1, wherein the drops contact a compressor blade and a compressor stator vane.

11. A method of claim 1, wherein the drops have a mean size that remains substantially constant between about 50 to about 150 μm.

12. A method of claim 1, wherein the turbine is rotated with the aid of a start motor.

13. A method of claim 1, wherein a fuel is burned in a combustion chamber of the gas turbine unit.

14. A method for cleaning a stationary gas turbine unit during operation, wherein the unit comprises: a turbine; a compressor driven by the turbine, the compressor having an air inlet; an air inlet duct arranged upstream of the air inlet of the compressor, the inlet duct having a part of the duct adjoining the inlet of the compressor and having decreasing cross section in an air flow direction defining a high-velocity area in order to give the air flow a final velocity at the inlet to the compressor, the method comprising:

providing one or more spray nozzles positioned at the acceleration duct; and introducing a spray of drops of cleaning fluid in the high-velocity area of the inlet duct, wherein the cleaning fluid is forced through the one or more spray nozzles and directed substantially parallel to and in the same direction as the direction of the air flow in order that the drops of the spray penetrate and stay in the air flow, to avoid leaving a liquid film within the high velocity area of the inlet duct, and the spray being introduced at a position in the duct section where the air velocity is a percentage of the final velocity at the compressor inlet.

15. A method of claim 14, wherein cleaning fluid is forced through the spray nozzle with a pressure drop that is dependent on the location of the nozzle, and with the pressure drop within the acceleration duct being greater than a pressure drop occurring in the inlet upstream of the acceleration duct so that the drops of the spray stay in the air flow instead of leaving a liquid film on the walls of the inlet duct.

16. A method of claim 15, wherein the drops of the spray have a mean size that is less than around 150 μm.

17. A method of claim 15, wherein the air velocity is at least 40 percent of the final velocity at the compressor inlet.

18. A method of claim 15, wherein the drops of the fluid spray acquire a slip ratio of at least 0.8 at the compressor inlet.

19. A method of claim 15, wherein the spray comprises a velocity within the range of about 100 m/s to about 200 m/s to enter the air flow and penetrate the compressor to wet and clean the rotating and fixed sections of the compressor and avoid substantial contact with the inlet structural supports.

20. A method of claim 14, wherein the drops contact a compressor blade and a compressor stator vane.

21. A method of claim 14, wherein the drops have a mean size that remains substantially constant between about 50 to about 150 μm.

22. A method of claim 14, wherein the turbine is rotated with the aid of a start motor.

23. A method of claim 14, wherein a fuel is burned in a combustion chamber of the gas turbine unit.

24. A system for cleaning a stationary gas turbine unit during operation, wherein the unit comprises:

a turbine;

a compressor driven by the turbine having an inlet; and an air inlet duct arranged upstream of the compressor, the air inlet duct having an acceleration duct adjoining the inlet of the compressor, the acceleration duct having a decreasing cross section in an air flow direction in order to increase the velocity of the air moving through the acceleration duct, with the air flow having a final velocity at the inlet to the compressor; the system comprising:

one or more nozzles positioned in the acceleration duct;

the one or more nozzles having cleaning fluid forced there through in order to form a spray of drops that penetrate the air flow; and the one or more nozzles directing the spray of drops in a direction substantially parallel to and in the same direction as the direction of the air flow, with the drops being carried by the air flow to contact one or more compressor blades for cleaning.

25. A system of claim 24, wherein the one or more nozzles are operated at a defined supply pressure to produce drops with mean size of around 50 to 150 μm.

26. A system of claim 24, wherein the one or more nozzles are operated at a defined supply pressure to produce a spray at a velocity within the range of about 100 m/s to about 200 m/s to allow injection into the compressor inlet air flow, wherein the spray enters the compressor inlet avoiding substantial contact with structural supports or boundaries of the inlet.

27. A system of claim 24, wherein the one or more nozzles are operated at a defined supply pressure to provide a spray with sufficient velocity within the range of about 100 m/s to about 200 m/s to enter the air flow and penetrate the compressor to wet and clean the rotating and fixed sections of the compressor.

28. A system of claim 27, wherein the cleaning fluid is forced through the spray nozzle with a pressure drop that is dependent on the location of the nozzle, and with the pressure drop within the acceleration duct being greater than a pressure drop occurring in the inlet upstream of the acceleration duct.

29. A system of claim 24, wherein the air inlet duct comprises a bell mouth and inner cone structure.

30. A system of claim 24, wherein the drops have a mean size that remains substantially constant between about 50 to about 150 μm.

31. A system of claim 24, wherein the turbine is rotated with the aid of a start motor.

32. A system of claim 24, wherein a fuel is burned in a combustion chamber of the gas turbine unit.

* * * * *